US005234782A

United States Patent [19]

Aslam et al.

[11] Patent Number: 5,234,782

[45] Date of Patent: Aug. 10, 1993

[54] METHOD OF TREATING TONER IMAGE BEARING RECEIVING SHEETS

[75] Inventors: Muhammad Aslam, Rochester; Thomas J. Farnand, Webster, both of N.Y.

[73] Assignee: Eastman Kodak Company, Rochester, N.Y.

[21] Appl. No.: 548,309

[22] Filed: Jul. 5, 1990

[51] Int. Cl.[5] ..... G03G 13/20

[52] U.S. Cl. ..... 430/99; 430/124

[58] Field of Search ..... 430/41, 99, 124, 98, 430/97, 45

[56] References Cited

U.S. PATENT DOCUMENTS

| | | | |
|---|---|---|---|
| T879,009 | 10/1970 | Staudenmayer et al. | 430/124 |
| 4,510,225 | 4/1985 | Kuehnle et al. | 430/124 |
| 4,639,405 | 1/1987 | Franke | 430/124 |
| 4,780,742 | 10/1988 | Takahashi et al. | 430/124 |
| 4,883,731 | 11/1989 | Tam et al. | 430/41 |
| 5,061,590 | 10/1991 | Johnson et al. | 430/45 |

FOREIGN PATENT DOCUMENTS

| | | |
|---|---|---|
| 0301585 | 2/1989 | European Pat. Off. . |
| 63-92965 | 4/1988 | Japan . |

*Primary Examiner*—John Goodrow
*Attorney, Agent, or Firm*—Leonard W. Treash

[57] ABSTRACT

A toner image is carried on a receiving sheet which receiving sheet includes a heat softenable outer layer. The image is fixed or finished by being fed between a pair of pressure members. The pressure members either embed the toner in the layer or apply a gloss or texture to the heat softenable layer. To eliminate an image defect at the leading edge of the sheet, coating of the sheet with the heat softenable layer is terminated one-eighth of an inch prior to the edge of the sheet.

7 Claims, 4 Drawing Sheets

METHOD OF TREATING TONER IMAGE BEARING RECEIVING SHEETS

TECHNICAL FIELD

This invention relates to finishing toner images and more particularly to a method of treating a receiving sheet having a heat-softenable layer carrying a toner image. It also relates to a receiving sheet for use in such a method and a print made by such a method.

BACKGROUND ART

In electrophotography, multicolor images having resolution and other qualities comparable to those of silver halide photography have been produced in the laboratory. One reason such systems have not been commercially practical is they have generally required liquid developing for high quality. However, recent advances in fine particle dry toners have made low-grain, high-resolution images feasible with dry systems.

U.S. patent application Ser. No. 07/405,258, filed Sep. 11, 1989, entitled TONER FIXING METHOD AND APPARATUS AND IMAGE BEARING RECEIVING SHEET, to Rimai et al, now U.S. Pat. No. 5,089,363 discusses a problem with such high resolution dry images that when they are put through an ordinary roller fuser they both spread, losing resolution, and exhibit a substantial relief image according to the varying thickness of toner layers in the image. The Rimai et al application suggests using a hard ferrotyping belt to embed the toner in a heat softened thermoplastic layer. The combination of relatively high pressure and the heat softened thermoplastic layer both substantially embeds the toner in the layer substantially reducing the relief and also applies a gloss to the image that is highly desirable in such a print.

U.S. patent application Ser. No. 07/409,194, filed Sep. 19, 1989, entitled METHOD AND APPARATUS FOR TREATING TONER IMAGE BEARING RECEIVING SHEETS, Baxter et al, now U.S. Pat. No. 5,112,717 deals with texturizing or adding gloss to a toner image-bearing receiving sheet generally of the type described in the Rimai et al application, that is, having a toner image on a thermoplastic layer. In this application the toner image-bearing sheet is fed between a pair of pressure rollers, one of which may have a texturizing surface and one of which is heated to again soften the thermoplastic layer to help impart the proper gloss or texture to its surface. To prevent offset of the thermoplastic layer onto the pressure roller contacting it, the layer was heated primarily by the roller contacting the side of the receiving sheet opposite the heat softenable layer.

The processes in the above two applications are done without the use of fusing oils because fusing oils leave image defects that are unacceptable with extremely high quality prints.

Japanese Kokai 63-92965 (1988), laid-open Apr. 23, 1988, suggests a method of increasing the gloss of a toner image bearing thermoplastic coated receiving sheet in which the receiving sheet is fed between a pair of pressure rollers to both reduce relief and to add gloss.

European Patent Application 0301585 published Feb. 1, 1989 shows a glazing sheet used to increase the gloss of either a toner image on paper backing or a dye and developer in a thermoplastic coating.

U.S. Pat. No. 4.639.405 shows a post-treatment step to add gloss to a toner image carried on a paper after ordinary fusing. The fixed image bearing paper is dried and then pressed between a pair of heated rollers which increase the gloss of the image.

U.S. Pat. No. 4,780,742 shows a method of increasing the gloss of a fixed toner image by coating it with a thin sheet in the presence of heat and pressure.

STATEMENT OF THE INVENTION

In finishing receiving sheets using some of the methods described in the above documents, it is desirable to feed the receiving sheet into the nip of a pair of moving pressure members which are urged together by enough force to create substantial pressures on the receiving sheet in the nip, for example, pressures up to 100 pounds per square inch and higher. In order to get high pressure, the member is urged together by forces as large as 40 pounds per linear inch and the pressure members are commonly hard metallic rollers. As suggested in the Rimai application, one of the rollers may be covered by a ferrotyping belt of nickel, stainless steel, or the like.

In many instances, an image defect occurs in this process associated with the leading one-eighth of an inch or so of the image. The leading edge of the thermoplastic layer has a tendency to offset onto the hot pressure member contacting it, leaving a visible mark on the final print and requiring cleaning of the pressure member.

It is an object of this invention to provide a method of heat and pressure treating a toner image-bearing thermoplastic coated receiver sheet without exhibiting this image defect associated with the leading edge of the thermoplastic layer.

It is another object of the invention to provide a receiving sheet for such a method.

It is another object of the invention to provide a print made by the above method.

These and other objects are accomplished by carrying out the method substantially as accomplished in the prior art except it is carried out with a receiving sheet in which the thermoplastic layer does not extend to the edge of the sheet.

We believe that the reason for the image defect at the leading edge of the thermoplastic layer is that the process of engaging the pressure members requires that the members be spread apart by the receiving sheet as it enters the nip. That process causes contact between one of the pressure members and the thermoplastic layer at the leading edge that is substantially longer than contact between that member and the rest of the thermoplastic layer. This causes localized heating of the leading edge of the thermoplastic layer substantially above its glass transition temperature which in turn causes offset. This explanation will be amplified below.

We have found that if the thermoplastic layer is recessed slightly from the edge of the substrate (usually paper), whatever mechanism causes the excess heating does not extend to the thermoplastic layer and no image defect occurs.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
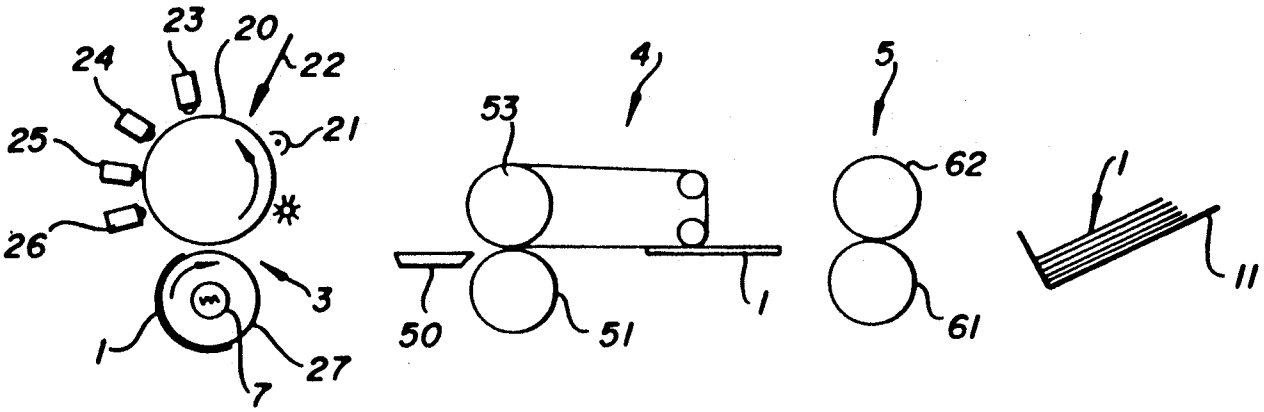
FIG. 1 is a side schematic view of an apparatus for carrying out a method of producing finished multicolor toner images.

According to FIG. 1 a receiving sheet 1 is fed along a path through a series of stations. The receiving sheet 1 is shown in section in FIG. 2 and has a paper support 10 with a readily softenable thermoplastic layer 9 coated on its top side. Preferably, the paper support 10 also has a curl preventing coating 8 on its bottom side. These materials will be explained in more detail below.

Receiving sheet 1 is fed through a path past an image transfer station 3, fixing station 4 and a texture or gloss applying station 5 and into a receiving hopper 11.

A multicolor toner image can be formed by a number of means on receiving sheet 1. For Example, according to FIG. 1, a photoconductive drum 20 is uniformly charged at a charging station 21, exposed by a laser, an LED or an optical exposure device at exposure station 22 and toned by different color toning stations 23, 24, 25 and 26. Consistent with conventional color electrophotography, consecutive images are toned with different colors by toning stations 23–26. The consecutive images are then transferred in registry to the surface of receiving sheet 1 at transfer station 3 where sheet 1 is secured to transfer roller 27 and repetitively brought into transfer relation with the images to form a multicolor toner image thereon. Single color images can also be formed by the same apparatus.

Extremely high-quality electrophotographic color work with dry toner particles requires extremely fine toner particles. Because of difficulties encountered in electrostatically transferring such small toner particles, transfer station 3 is preferably of the thermally assisted type, in which transfer is accomplished by heating both the toner and the thermoplastic layer of the receiving sheet causing preferential adherence between the toner and receiving sheet as compared to the toner and whatever surface is carrying it, in this instance photoconductive drum 20. For this purpose, transfer roller 27 is heated by a lamp 7 which heats the thermoplastic layer 9 to its glass transistion temperature which assists in the transfer of the toner to layer 9 by facilitating the partial embedding of the toner in layer 9.

A multicolor image can also be formed using an intermediate drum or web to which two or more color toners are transferred in registry and then transferred as a single multicolor image to a receiving sheet. Sheet 1 can also receive a multicolor image directly from drum 20 in a single transfer. That image is formed on a photoconductive drum 20 by a known process which exposes and develops second, third and fourth color images on top of previously formed color images.

In summary, any of a number of known techniques may be used to provide a multicolor image of dry, extremely fine toner particles on or slightly embedded in the upper thermoplastic surface of the receiving sheet 1.

Figure 2:
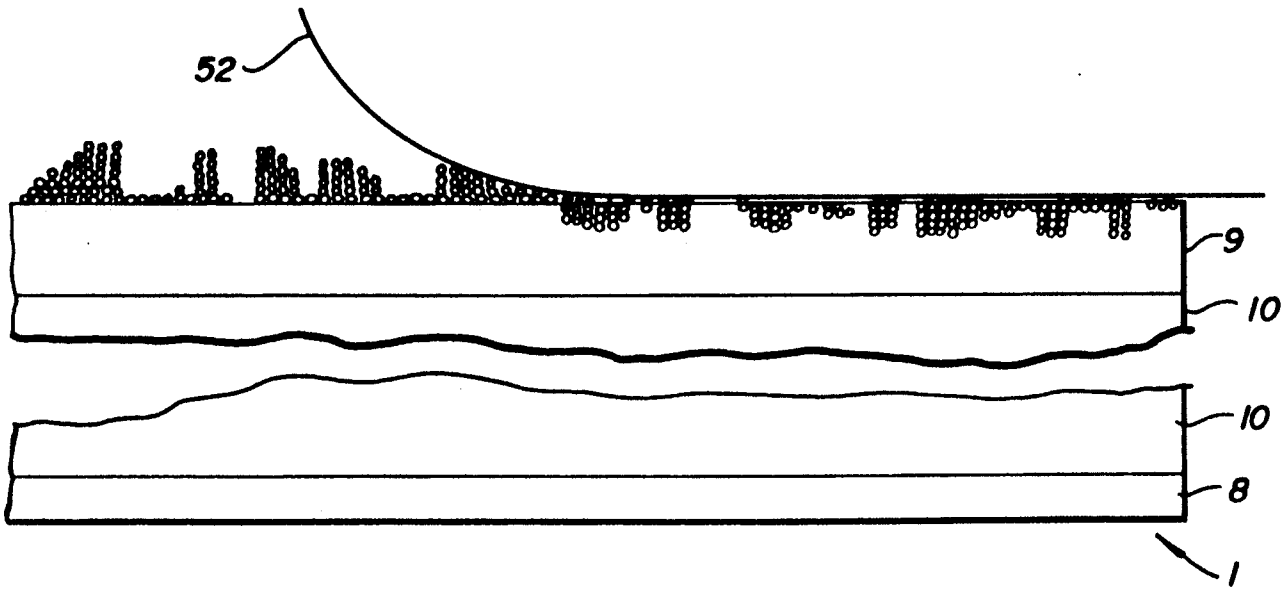
FIG. 2 is a side section greatly magnified illustrating a receiving sheet while toner is being embedded with the apparatus of FIG. 1.

Referring to FIG. 2, these finely-divided toner particles (exaggerated in size in FIG. 2) have a tendency to extend in layers a substantial and varying height above the surface of receiving sheet 1. Ordinary pressure roller fusing has a tendency to only partially flatten the layers of toners. However, it also spreads such layers, increasing substantially the granularity of the image and noticeably impairing its quality.

Further, the fine toner has a tendency to offset on the pressure fuser unless fusing oils are used. Such fusing oils, while acceptable for ordinary copying work, leave blotches on the sheet surface that are unacceptable for very high quality imaging.

Figure 4:
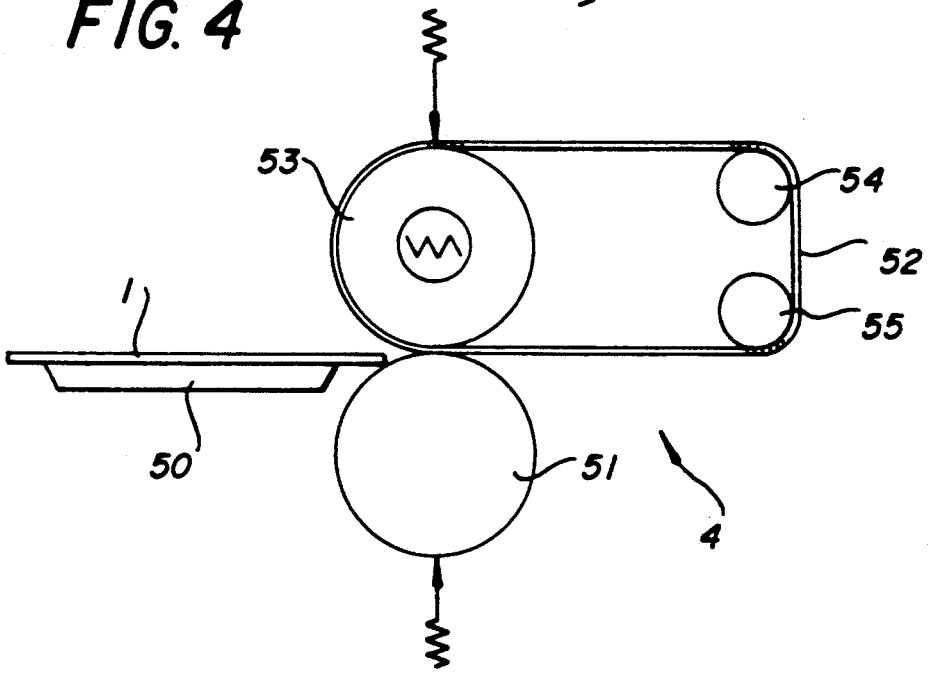
FIG. 4 is a side schematic of one of the components shown in FIG. 1 for embedding the image and applying a gloss to such a receiving sheet.

FIG. 4 illustrates a fixing device 4 shown in FIG. 1 and partially shown in FIG. 2. Fixing device 4 reduces the relief and fixes the toner image in the thermoplastic layer of the receiving sheet. It also can increase the gloss of the surface of the sheet. According to FIG. 4, receiving sheet 1 is fed across a preheating device 50 and into the nip between a pressure roller 51 and a ferrotyping belt 52. Ferrotyping belt 52 is entrained around a large heated roller 53 and unheated rollers 54 and 55. One of the rollers 53, 54 or 55 is rotated by means not shown to drive the belt. Preheating device 50 elevates the temperature of the thermoplastic layer 9 (FIG. 2) to slightly above its glass transistion temperature permitting the ferrotyping web 52 to embed the toner in layer 9 as shown in FIG. 2. Although this process can work with some materials at pressures as low as 40 pounds per square inch and lower, preferably, it is carried out at much higher pressures. For example, pressures of 100 pounds per square inch or greater have been found to be useful.

Figure 3:
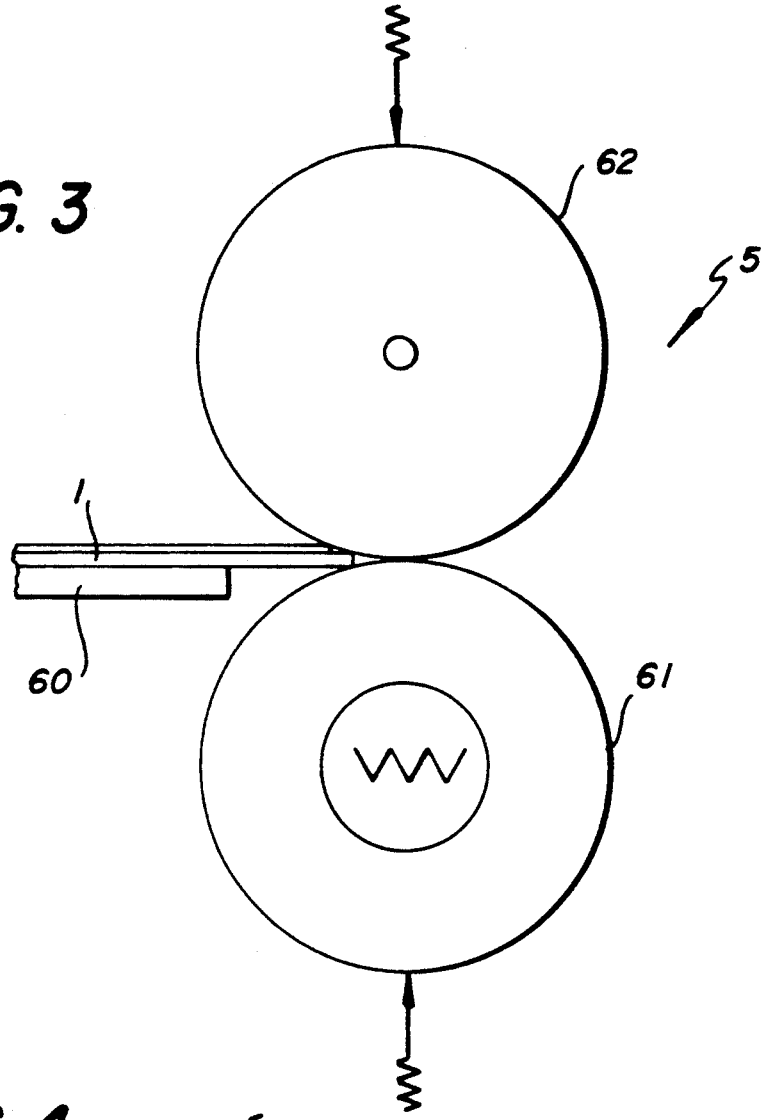
FIG. 3 is a side schematic of one of the components of the apparatus shown in FIG. 1 for applying a texture or gloss to a receiving sheet of the type shown in FIGS. 2 or 11.

According to FIG. 3, further gloss or a texture can be applied to the surface of the print by a second treatment similar to the first. As shown in FIG. 3, receiving sheet 1 is fed into a nip between a pair of pressure rollers 61 and 62 after again being heated by preheating device 60. Preferably, lower pressure member 61 is heated sufficiently to, in cooperation with preheating device 60, maintain the thermoplastic layer 9 above its glass transition temperature while the pressure members impart a gloss or texture to the surface of sheet 1. Again, relatively high pressures, preferably, 100 pounds per square inch or greater assist in the process. To apply such high pressures, both pressure members are made of metal, for example, aluminum.

In working with both of the devices shown in FIGS. 3 and 4, an image defect was noted at the leading edge of the print. That is, there was a substantial mark in the first 1 millimeter of the final image. Upon analysis, it was determined that the leading edge of thermoplastic was offsetting onto the pressure member. In addition to the image defect, the portion of layer 9 that offsets on the pressure member must be cleaned off or it will cause more offset of both layer 9 and toner from the image.

This offset at the leading edge could be due to any of several phenomenas. For example, if the pressure member contacting the sheet is slightly overheated it will cool somewhat upon contact with the thermoplastic layer. But, the leading edge of the thermoplastic will be overheated.

Secondly, when the receiving sheet 1 engages the nip, the drives for the pressure members must overcome the initial inertia associated with driving the receiving sheet. This slows the rollers momentarily, causing them to maintain contact with the leading edge longer than they would remain in contact with the rest of the sheet and causes them to overheat.

Figure 5:
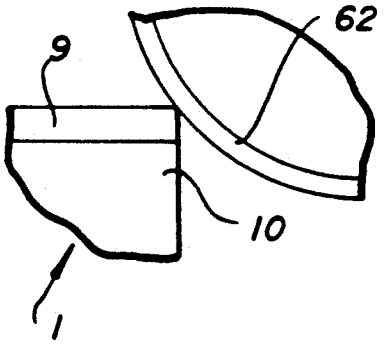
FIGS. 5, 6 and 7 are magnified side sections of the contact area between the prior art receiving sheet and one of the pressure members illustrating the mechanism that is believed to cause an observable image defect and offset of thermoplastic onto the upper pressure member.
Figure 8:
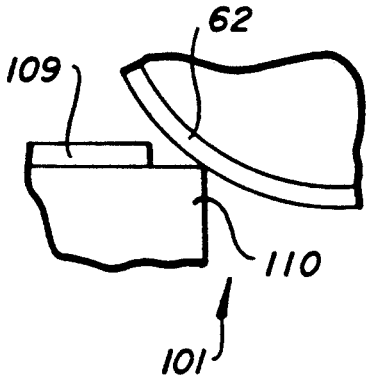
FIGS. 8, 9 and 10 are cross-sections similar to FIGS. 5, 6 and 7 illustrating essentially the same contact areas as FIGS. 5, 6 and 7 but with a receiving sheet constructed according to the invention.
Figure 6:
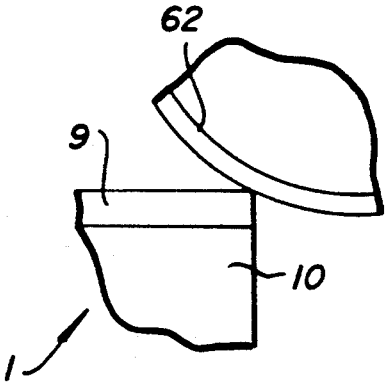
Figure 9:
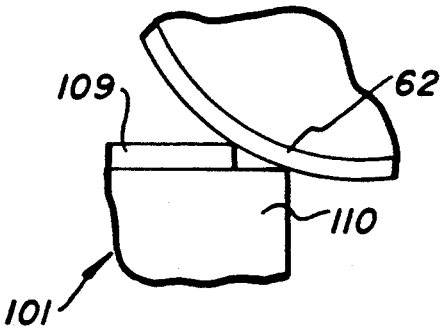
Figure 7:
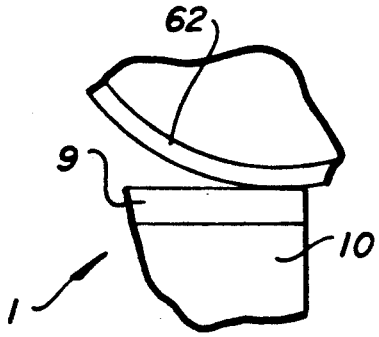

A third explanation, is illustrated in FIGS. 5, 6 and 7. According to FIG. 5 the receiving sheet itself has thickness which causes the top corner edge of the receiving sheet to engage pressure member 62 at a position slightly upstream of pressure member 62's point of contact with the other pressure member 61. As shown in FIG. 6, as the sheet 1 advances it spreads the pressure members apart but the leading edge continues to contact pressure member 62 until finally as shown in FIG. 7 it reaches what was the point of contact between pressure members 61 and 62. The rest of layer 9 contacts pressure member 62 only in the area surrounding the positions of contact between pressure member 62 and 61 when the sheet was not present. However, the leading edge of layer 9 has contacted the pressure member substantially in advance of that point as shown in FIGS. 5 and 6. Thus, the leading edge of layer 9 has been overheated by member 62 and offsets onto layer 62 leaving the image defect.

According to FIGS. 8–12, this defect can be cured by using a method in which a receiving sheet 101 has a thermoplastic layer 109 which does not extend all the way to the edge of sheet 101, but instead terminates a short distance therefrom. Thus, according to FIGS. 8 and 9 the initial contact between receiving sheet 101 and pressure member 62 is a contact between the edge of the substrate 110 which in most instances is ordinary paper. According to FIGS. 9 and 10, the pressure members have spread apart adequately by the time that the leading edge of layer 109 is reached by pressure member 62 it is at about the same position in the nip that the rest of layer 109 will be when it initially contacts pressure member 62. There will thus be substantially even heating of the entire layer 109.

Figure 10:
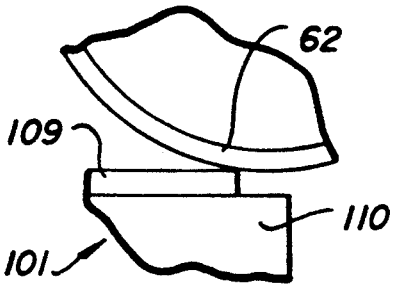

Similarly, any slowing of the rotation of pressure member 62 due to the inertia associated with contact with receiving sheet 101 has been overcome by the time layer 109 reaches pressure member 62 in FIG. 10, and pressure member 62 has resumed its original speed. Note that the thickness of layer 109 has been exaggerated in the Figs. to aide in the illustration. That layer is sufficiently thin that contact with the layer 109 at a point recessed from the edge of substrate 110 does not materially slow pressure member 62.

The distance between the end of layer 109 and the edge of sheet 101 that is necessary to overcome the defect, depends, of course, on the materials used, the size of the drives for the pressure members, the thickness of the layers and the temperatures involved. However, for most materials we have found that if layer 109 terminates about one-eight of an inch from the edge of receiving sheet 101 no leading edge defect is observed.

Figure 11:
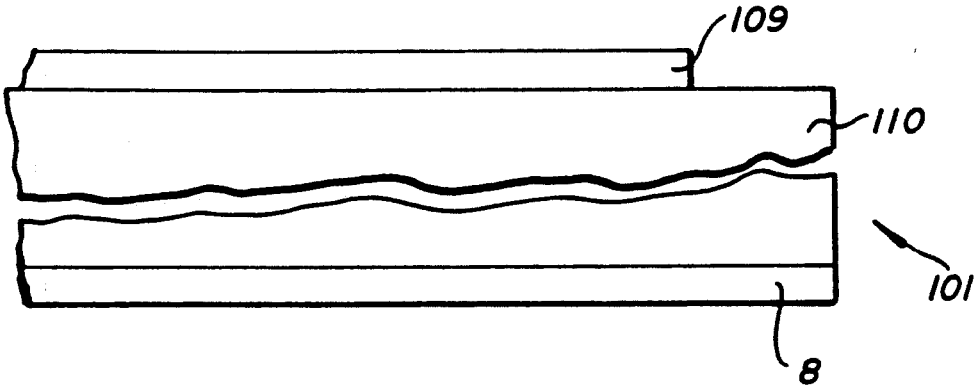
FIGS. 11 and 12 are cross sections greatly magnified illustrating a receiving sheet for practicing the method illustrated in FIGS. 8, 9 and 10 and a finished print obtained from such method, respectively.
Figure 12:
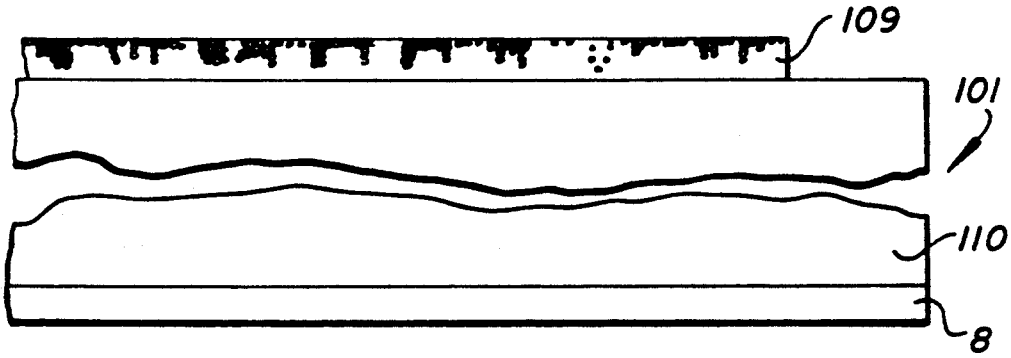

For example, referring to FIG. 11, a receiving sheet 101 includes a paper substrate 110 which is 9.0 mils thick and has a thermoplastic layer 109, 0.5–1.00 mil thick, having a glass transition temperature between 55 and 60 degrees C. A high melting point polyethylene layer 8 also one mil thick is coated on the non-image side to prevent curl. No offset was observed when fed through both the fixing device shown in FIG. 4 and the treating device of FIG. 3, when the leading edge of the polyester is terminated one-eighth inches before the edge of paper substrate 110. The finished print is illustrated in FIG. 12.

Figure 13:
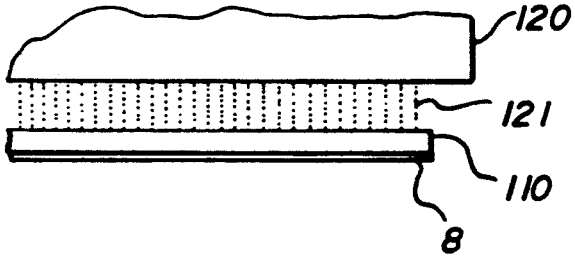
FIG. 13 illustrates a method of making the receiving sheet shown in FIG. 11.

FIG. 13 illustrates formation of layer 109 by coating paper substrate 110 using a conventional coating hopper 120 which is set to coat layer 109 by coating thermoplastic 121 only out to about a distance of one-eighth of an inch from the edge of substrate 110. Curl preventing polyethylene layer 8 can be coated all the way to the edge or also stop one-eighth of an inch from the edge, as shown in FIG. 13. The stiffness of most paper will not permit curl in either case, but for very thin paper, coating layer 8 is also short of the edge to the same extent as layer 109 is preferred.

This invention has at least two practical applications. In photofinishing with borders the white border will hide the lack of thermoplastic on one (or all) edges. Secondly, in borderless prints, the uncoated portion does not contain image so would be cropped. The defect also could be cropped, but, with the invention, no thermoplastic must be cleaned off the pressure member.

The invention has been described in detail with particular reference to a preferred embodiment thereof, but it will be understood that variations and modifications can be effected within the spirit and scope of the invention as described hereinabove and as defined in the appended claims.

We claim:

1. In a process of treating a toner image bearing receiving sheet, which receiving sheet includes a heat softenable outer layer carrying said toner image, which process includes feeding said sheet into a nip formed by sheet advancing pressure members in the presence of sufficient heat and pressure to embed the toner image in said heat softenable layer or to apply a glass or texture to said heat softenable layer, the improvement wherein said feeding step includes feeding a receiving sheet whose heat softenable layer terminates a short distance from that edge of said sheet which first contacts said moving pressure members.

2. The process according to claim 1 wherein said feeding step includes feeding said sheet between a pair of pressure rollers, one of which rollers has a surface which applies a texture or gloss to said heat softenable outer layer.

3. The process according to claim 1 wherein said step of feeding said sheet between moving pressure members includes feeding said sheet between pressure members which have been heated sufficiently to raise or maintain the temperature of said heat softenable layer above its glass transition temperature and said pressure members include a ferrotyping web which contacts the heat softenable layer to embed said toner image in said heat softenable layer.

4. The process according to claim 3 further including the step of heating said ferrotyping belt to a temperature substantially above the glass transition temperature of said heat softenable layer in order to maintain said heat softenable layer above said glass transition temperature.

5. An electrophotographically made print comprising:

a substrate, a heat softenable outer layer, which layer terminates at least one-eighth of an inch from one edge of said substrate, and an electrophotographically produced toner image embedded in said outer layer.

6. A receiving sheet usable in a process in which a toner image is transferred to a receiving sheet and said receiving sheet is fed a pair into a nip formed by sheet advancing of pressure members for applying both heat and pressure to said sheet for fixing said toner image, said receiving sheet comprising:

a thick substrate, a thin heat softenable outer layer, which layer terminates at least one-eighth of an inch from one edge of said substrate and which layer has a glass transition temperature between 55° and 60° C.

7. The process according to claim 1 wherein the feeding step includes feeding a receiving sheet having a thin heat softenable layer that terminates at least one-eighth of an inch from that edge of said sheet which first contacts said moving pressure members.

* * * * *

UNITED STATES PATENT OFFICE

CERTIFICATE OF CORRECTION

Patent No. 5,234,782 Dated August 10, 1993

Inventor(s) Muhammad Aslam; Thomas J. Farnand

It is certified that error appears in the above-identified patent and that said Letters Patent is hereby corrected as shown below:

| | |
|---|---|
| Column 6, line 44 | Delete "glass" and substitute ---gloss. |
| Column 7, line 12, | Delete "a pair". |
| Column 7, line 12 | After "by" insert ---a pair of---. |
| Column 7, line 13 | Delete "of". |

Signed and Sealed this

Fifteenth Day of March, 1994

*Attest:*

Bruce Lehman

BRUCE LEHMAN

*Attesting Officer*

*Commissioner of Patents and Trademarks*